US007155954B2

(12) United States Patent
Battenfeld

(10) Patent No.: US 7,155,954 B2
(45) Date of Patent: Jan. 2, 2007

(54) PLIERS FOR CRIMPING WORK PIECES

(75) Inventor: Kurt Battenfeld, Ebsdorfergrund-Wittelsberg (DE)

(73) Assignee: Wezag GmbH Werkzeugfabrik, Stadtallendorf (DE)

( * ) Notice: Subject to any disclaimer, the term of this patent is extended or adjusted under 35 U.S.C. 154(b) by 93 days.

(21) Appl. No.: 10/957,834

(22) Filed: Oct. 4, 2004

(65) Prior Publication Data

US 2005/0076697 A1 Apr. 14, 2005

(30) Foreign Application Priority Data

Oct. 6, 2003 (DE) ..... 103 46 241

(51) Int. Cl.
*B21D 7/06* (2006.01)

(52) U.S. Cl. ..... 72/409.07; 72/409.12; 81/313; 81/393

(58) Field of Classification Search ..... 72/409.12, 72/409.19, 409.07; 29/751; 81/313, 393, 81/427.5, 341, 343

See application file for complete search history.

(56) References Cited

U.S. PATENT DOCUMENTS 1,123,243 A * 1/1915 Champ ..... 81/393
3,170,345 A * 2/1965 Poingt ..... 72/409.12
4,144,737 A * 3/1979 Izraeli ..... 72/409.11
4,158,302 A * 6/1979 O'Loughlin ..... 72/409.16
4,170,154 A 10/1979 Izraeli
4,794,780 A * 1/1989 Battenfeld ..... 72/409.01
5,236,331 A * 8/1993 Liu ..... 72/461
6,116,124 A 9/2000 Ping
6,474,130 B1 11/2002 Battenfeld

FOREIGN PATENT DOCUMENTS

DE 199633097 C1 4/1920

* cited by examiner

*Primary Examiner*—Daniel C. Crane
(74) *Attorney, Agent, or Firm*—Thomas, Kayden, Horstemeyer & Risley LLP

(57) ABSTRACT

Pliers for crimping work pieces include a pliers head, a first pivot jaw (4) and a second pivot jaw (3). A common joint (5) pivotally connects the first and second pivot jaw (4, 3). Two dies together form a crimping die (8). A first handle (2) is connected to the first pivot jaw (4). The first handle (2) is divided into at least a first portion (21) and a second portion (22). The first portion (21) is designed as a plate. A second handle (1) is connected to the second pivot jaw (3). The first handle (2) and the second handle (1) are movable with respect to one another and operable to crimp the work piece in a few crimping steps. A locking mechanism (28) includes a tooth segment (29), and it serves to attain a defined closed position of the dies. The tooth segment (29) is designed as one piece with the first portion (21). A stop mechanism (31) includes at least two stops, and it connects the first portion (21) and the second portion (22) in a plurality of different angle positions. The stops are designed as one piece with the first portion (21). A toggle lever drive (27) includes a plurality of support joints and a pressure lever (16). The pressure lever (16) connects the first portion (21) to the second handle (1). The pressure lever (16) is supported by the support joints.

15 Claims, 6 Drawing Sheets

PLIERS FOR CRIMPING WORK PIECES

CROSS REFERENCE TO RELATED APPLICATIONS

This application claims priority to co-pending German Patent Application No. 103 46 241.4 entitled "Zange zum Verpressen von Werkstücken", filed Oct. 6, 2003.

Field of the Invention

The present invention generally relates to pliers for crimping work pieces. Pliers of this kind are also called crimping pliers or pressing pliers. Depending on the design of the work piece to be crimped, especially in case of fittings, tubes and the like, substantial pressing forces have to be applied onto the work piece. More particularly, the present invention relates to pliers which are operable with one hand and which serve to apply great crimping forces onto the work piece in a few crimping steps. On the other hand, such work pieces, especially tubes and fittings, may have comparatively great diameters. Consequently, the crimping die being formed by two dies of the pliers should have a great opening width in the opened position of the pliers to be able to move the two dies over the work piece to be crimped in the opened position of the pliers.

BACKGROUND OF THE INVENTION

Pliers for crimping work pieces are known from German Patent No. DE 199 63 097 C1 corresponding to U.S. Pat. No. 6,474,130 B2. The known pliers include a pliers head, a first pivot jaw being arranged in the region of the pliers head and a second pivot jaw being arranged in the region of the pliers head. A common joint pivotally connects the first and second pivot jaw. A first die is arranged at the first pivot jaw. A second die is arranged at the second pivot jaw. The first die and the second die together form a crimping die for crimping the work piece. A first handle is operatively connected to the first pivot jaw, and it includes an end portion facing away from the pliers head. The first handle is divided into at least a first portion and a second portion. A second handle is operatively connected to the second pivot jaw, and it includes an end portion facing away from the pliers head. The first and second handle are designed and arranged to be movable with respect to one another and to be operable to crimp the work piece in a few crimping steps. The second portion of the first handle is coupled to the first portion of the first handle in a plurality of different angle positions by a stop mechanism including at least two stops. Each angle position corresponds to one crimping step in a way that the end portions of the first and second handle may be held and operated by the fingers of one hand of the operator in each angle position of each crimping step. A locking mechanism is designed and arranged to attain a defined closed position of the first and second die during the closing movement of the dies. The locking mechanism includes a tooth segment. A toggle lever drive includes a plurality of supporting joints and a pressure lever operatively connecting the first and second handle. The pressure lever is supported by the plurality of supporting joints. In this way, it is possible to apply great crimping forces onto the work piece even during difficult assembly conditions such as overhead or narrow working conditions. The two portions of the movable handle are pivotally interconnected. The sum of the lengths of the two lever arms of the portions of the handle approximately corresponds to the length of the lever arm of the stationary handle. The crimping steps result from a change of the angle position of the two portions of the movable handle. The portion of the movable handle facing the pivot jaw has a design as it is known from handles. A separate element in the form of a tooth segment being part of the locking mechanism is fixedly connected to this portion of the handle. The tooth segment of the locking mechanism is supported in a joint on the portion of the handle facing the movable pivot joint and fixed by a pin connection or a bolt connection. The stops of the stop mechanism are separately designed and arranged at the two portions of the movable handle without any relation to the locking mechanism. The design and arrangement of the stop mechanism at the two portions of the movable handle takes place approximately in the middle of the axial length of the pliers such that the two portions of the movable handle attain a functional relative position in the different positions. However, this relative position of the two portions of the movable handle is buckled in a somewhat awkward way. This is sometimes found to be disturbing since the movable handle in contrast to the stationary handle has this somewhat strange buckled design which is not parallel to the stationary handle.

Pliers are also known from U.S. Pat. No. 4,170,154. The pliers include two handles which are movable with respect to one another. The free ends are rotatable about a common pivot joint. A locking mechanism is arranged between the two pivot jaws. The locking mechanism includes special elements in the form of a tooth segment and a pivotally arranged locking tooth. The locking mechanism serves to attain a defined end position during the closing movement of the pliers. The pliers only allow for a one-step closing movement of the pivot jaws while the handles approach.

Pliers are also known from U.S. Pat. No. 6,116,124. The known pliers are designed such that their opening width is adjustable. The pliers include two handles which are movable with respect to one another. Each of the handles is fixedly connected to the respective pivot jaw. Some kind of a locking mechanism is arranged between the two handles. One of the support locations of the locking mechanism is arranged to be displaceable by the force of a spring. Again, the handle and the corresponding pivot jaw are designed as one piece. The known pliers are designed to include plates. It is to be understood that each element of the pliers which is functionally designed as one piece may however include a plurality of plates in the sense of a so called plate design.

SUMMARY OF THE INVENTION

The present invention relates to pliers for crimping work pieces. The pliers include a pliers head, a first pivot jaw being arranged in the region of the pliers head, a second pivot jaw being arranged in the region of the pliers head and a common joint being designed and arranged to pivotally connect the first and second pivot jaw. A first die is arranged at the first pivot jaw. A second die is arranged at the second pivot jaw. The first and second dies together form a crimping die. A first handle is operatively connected to the first pivot jaw, and it includes an end portion facing away from the pliers head. The first handle is divided into at least a first portion and a second portion. The first portion is designed as a plate. A second handle is operatively connected to the second pivot jaw, and it includes an end portion facing away from the pliers head. The first handle and the second handle are designed and arranged to be movable with respect to one another and to be operable to crimp the work piece in a few crimping steps. A locking mechanism includes a tooth segment, and it is designed and arranged to attain a defined closed position of the first die and the second die. The tooth segment is designed as one piece with the first portion of the first handle. A stop mechanism includes at least two stops, and it is designed and arranged to operatively connect the first portion and the second portion of the first handle in a plurality of different angle positions. The at least two stops are designed as one piece with the first portion of the first handle. A toggle lever drive includes a plurality of support joints and a pressure lever. The pressure lever operatively connects the first portion of the first handle and the second handle. The pressure lever is supported by the plurality of support joints.

The novel pliers have a simplified design with respect to the locking mechanism and the stop mechanism. This novel design makes it possible that the pliers have a comparatively flat design and that the movable handle has a straight design along a substantial portion of its axial length.

The novel pliers combine elements of the locking mechanism and of the stop mechanism in a way that they are formed at the first portion of the handle facing the movable pivot jaw. The first portion of the handle which faces the movable pivot jaw generally has a one-piece design. However, when using a plate design of the pliers, this portion includes two corresponding plates which may have been produced by punching to simplify manufacture of the handle. This means that the handle with respect to the function of the locking mechanism and of the stop mechanism does not include separate elements which are fixedly interconnected. Instead, the first portion of the handle has a circumference which has such a design that the tooth segment of the locking mechanism as well as the stops of the stop mechanism for the different angle positions are formed thereon. Thus, the stop mechanism is located at a different place compared to prior art pliers. At the same time, compared to the prior art, the stop mechanism is transferred from the region of the movable handle into the region of the head of the pliers. Consequently, a great portion of the movable handle has an elongated straight design different from the somewhat awkward buckled design known from the prior art. In this way, the number of components of the pliers is reduced and one attains the possibility of a comparatively flat structure of the pliers. The first portion of the handle now fulfills a plurality of functions. The remaining elements of the locking mechanism, especially the locking tooth being subjected by a spring, are located in the region of the pressure lever and of the pressure levers, respectively. The stop mechanism includes a ratchet being biased by a spring, the ratchet being associated in the portion of the movable handle which faces away from the movable pivot jaw.

The first portion of the handle (which includes a plurality of portions) which faces the movable pivot jaw may include the stops arranged in the form of a series of teeth, a tooth segment, and the like. The first portion of the handle has a lever arm which is shorter compared to the prior art. However, the number of crimping steps may be increased depending on the number of stops. Usually, the arrangement of a few stops in the stop mechanism, especially two to five stops, is sufficient. The number of stops corresponds to the number of crimping steps. However, one may also chose a greater number of crimping steps and of stops.

The tooth segment of the locking mechanism as well as the stops of the stop mechanism preferably extends over the entire thickness of the first portion of the handle facing the movable pivot jaw. In this way, they may be easily produced by punching without losing required stability. The plate-shaped punching element of the first portion of the handle may be designed as one piece or also to include two pieces, respectively. Preferably, the arrangement is chosen to be symmetric with respect to the plane of main extension of the pliers, meaning also in the center of the thickness of the pliers. Two pressure levers may then be arranged symmetrically within the thickness of the pliers as seen from the inside towards the outside. These pressure levers may also be designed as punching elements. Preferably, they are located in the same plane as the pivot jaws and as the part of the pivot jaws facing the first portion of the handle, respectively. In case the crimping dies located in the pivot jaws are not designed to be replaceable, the pivot jaws may be designed to fulfill the function of the crimping die.

There are a number of possibilities of designing the movable handle. The two portions of the movable handle may be supported in a common joint located at the movable pivot jaw. In this way, the movable handle substantially maintains its stretched elongated design. Thus, the separation of the two portions of the handle which is functionally maintained is optically rather unapparent. Such an embodiment of the pliers advantageously has a low number of joints such that the two handles may have the approximately same thickness. However, it is also possible that the second portion of the movable handle facing away from the movable pivot jaw is supported at the first portion of the handle facing the movable pivot jaw by an additional joint. This embodiment of the pliers requires the use of an additional joint, but it may allow for a smaller structure of the pliers.

Independent of the respective structure of the stops located on the first portion of the handle, a manually operable ratchet being biased by a spring may be associated with the second portion of the movable handle. The ratchet being biased by a spring has such a design that it automatically causes the pliers to reach the following crimping step when slightly opening the handles of the pliers. Manual operation of the ratchet being subjected by a spring is only necessary to prepare the start of another crimping operation with the pliers at a different work piece.

The end of the pressure lever facing away from the first portion of the handle may include an elongated hole to allow for wide opening of the crimping die. Alternatively, it may be guided in an elongated hole being located in the stationary handle. Furthermore, the arrangement of an eccentrically adjustable bearing of the pressure lever is possible to adjust the exact closing position of the crimping jaws.

For reasons of symmetry, there may be two pressure levers being arranged symmetric with respect to the plane of main extension of the pliers, while the first portion of the movable handle is located in the center.

The tooth segment of the locking mechanism as well as the stops of the stop mechanism for the different angle positions are arranged at the first portion of the handle in the same sense of rotation. Consequently, the locking mechanism is released at the end of a crimping operation after actuation of the last crimping step.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
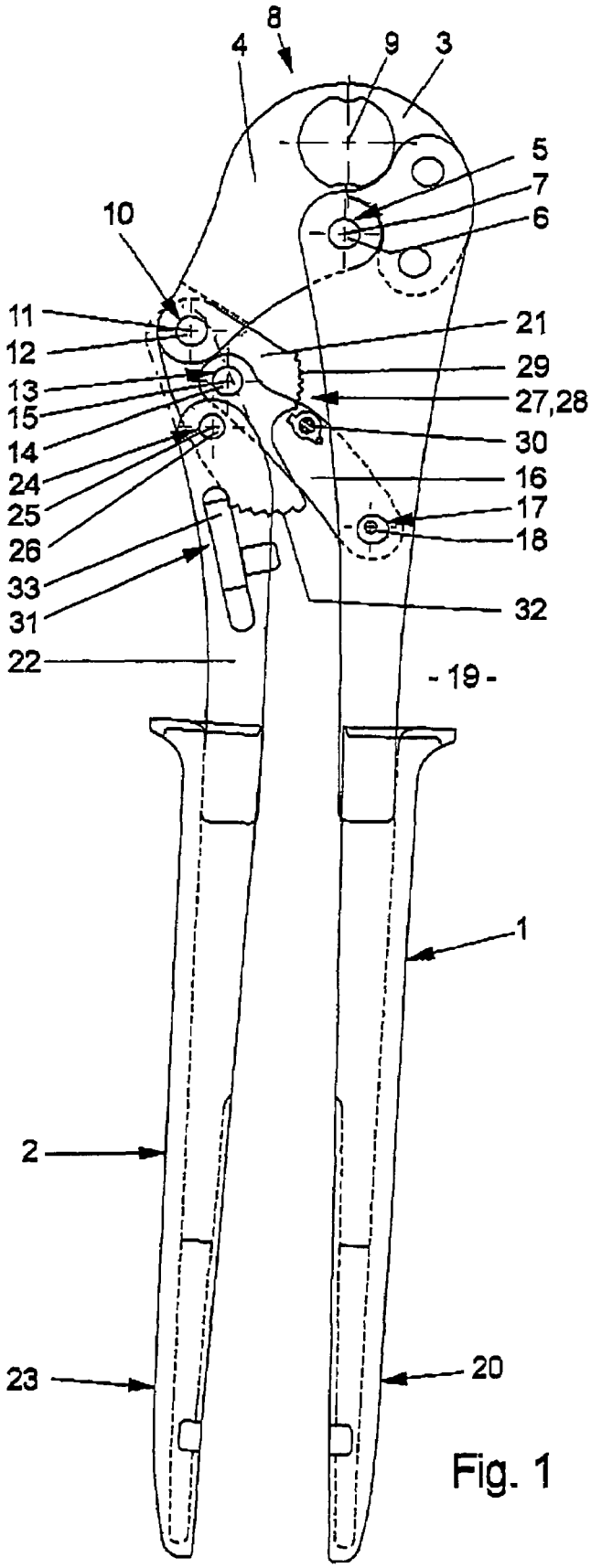
FIG. 1 is a top view of a first exemplary embodiment of the novel pliers in its plane of main extension.

Referring now in greater detail to the drawings, FIG. 1 illustrates a first exemplary embodiment of the novel pliers including handles 1 and 2. The handle 1 is fixedly connected to a pivot jaw 3 to be commonly rotated and such that these two elements form a stationary portion of the pliers. The pivot jaw 3 and the handle 1 may also be designed as one piece. The handle 1 is also referred to as stationary handle, although, for an activation of the pliers, it is only important that there is a relative movement of the handles 1 and 2 with respect to one another. In addition to the stationary pivot jaw 3, there is a movable pivot jaw 4 being pivotally connected to the stationary portion of the pliers 1, 3 by a joint 5. The stationary handle 1 may be designed as a semi shell or to have a plate design such that its legs or plates extend approximately symmetrically to the plane of main extension 19 of the pliers. The same applies to the movable handle 2. A pin 6 extends through the legs or plates, the movable pivot jaw 4 being designed and arranged to be pivotal with respect to the stationary pivot jaw 3 about the axis 7 of the pin 6. A crimping die 8 is located at the pivot jaws 3 and 4. The crimping die 8 may be designed to be replaceable or to form one piece with the pivot jaws 3, 4. In the exemplary embodiment of FIG. 1, the crimping die 8 is formed by two dies being designed in the form of semi shells (not illustrated). The semi shells are removeably or replaceably inserted into the pivot jaws 3, 4. The axial length of the semi shells perpendicular to the plane of main extension 19 also forming the plane of illustration covers the length of a union stem onto which, for example, a tube is to be connectingly and sealingly crimped with the pliers. Preferably, the axis 9 of the crimping die 8 is to be located close to the joint 5, meaning at a distance between the axis 7 and 9 being chosen to be as small as possible.

The movable pivot jaw 4 being associated with the movable handle 2 is enlarged in a lateral direction with respect to the stationary handle 1 to arrange a first support joint 10, the axis 11 of which being formed by a pin 12. The movable handle 2 engages the pin 12.

A second support joint 13 is arranged at the movable handle 2, the support joint 13 being formed by a pin 14 having an axis 15. A pressure lever 16 being arranged between the handles 1 and 2 is pivotally supported by the pin 14. The other end of the pressure lever 16 is pivotally supported in a third support joint 17. The support joint 17 may be formed by an eccentric pin 18. The eccentric surface of the eccentric pin 18 supports the pressure lever 16. The eccentric pin 18 is rotatably connected to the stationary handle 1. The eccentric cam of the eccentric pin 18 is dislocated with respect to the pressure lever 16 during rotation. Thus, eccentricity changes its position. In this way, the effective length of the pressure lever 16 and/or the exact closed position of the crimping dies may be adjusted.

The stationary handle 1 is designed as a continuous lever. Thus, the length of the lever of the stationary handle 1 corresponds to the distance between the joint 5 and its free and portion 20. The movable handle 2 is divided into two portions 21 and 22. The second portion 22 is substantially longer than the first portion 21. The first portion 21 faces the pivot jaw 4, and it is supported to be pivoted about the first support joint 10. The second portion 22 is pivotally supported at the first portion 21 by a fourth support joint 24 including an axis 25 and a bolt 26.

The first portion 21 of the movable handle 2 and the pressure lever 16 together form a toggle lever drive 27. The pressure lever 16 includes two levers being symmetrically arranged with respect to the plane of main extension 19. A locking mechanism 28 is arranged at the pressure lever 16 and at the first portion 21. The locking mechanism 28 includes a tooth segment 29 being located at the circumference of the first portion 21 and a locking jack 30. The locking jack 30 includes a locking tooth which cooperates with the tooth segment 29. The locking jack 30 is pivotally supported on a bolt, and it is kept in a center position by a spring.

A stop mechanism 31 is operatively arranged between the portions 21 and 22 of the handle 2. The stop mechanism 31 is designed and arranged to allow for support of the portions 21 and 22 at one another in a few angle positions corresponding to a few crimping steps of the pliers. The stop mechanism 31 includes a plurality of stops 32. The stops 32 are arranged in series at the circumference of the first portion 21. They may also be arranged at the portion 21 in an arc-shaped configuration. The stops 32 cooperate with a ratchet 33 in a stepwise manner. The ratchet 33 is designed to be subjected by a spring and to be operable by hand. The ratchet 33 includes a locking member which is pressed towards the stops 32 and the first portion 21, respectively, by the force of a spring (not illustrated). The number of stops 32 and the number of positions realized thereby correspond to the number of crimping steps. The first portion 21 does not only fulfill its function with respect to the toggle lever drive 27. In addition, components of the locking mechanism 28 and of the stop mechanism 31 are arranged at the portion 21. In this way, the number of components of the pliers is reduced, and the pliers also have a flat structural design (FIG. 2).

To attain the desired visual impression of a continuous second lever 2, the second portion 22 may extend beyond the fourth support joint 24 to reach the portion of the first support joint 10, as this is illustrated by the dot-dash-line in FIG. 1.

Figure 2:
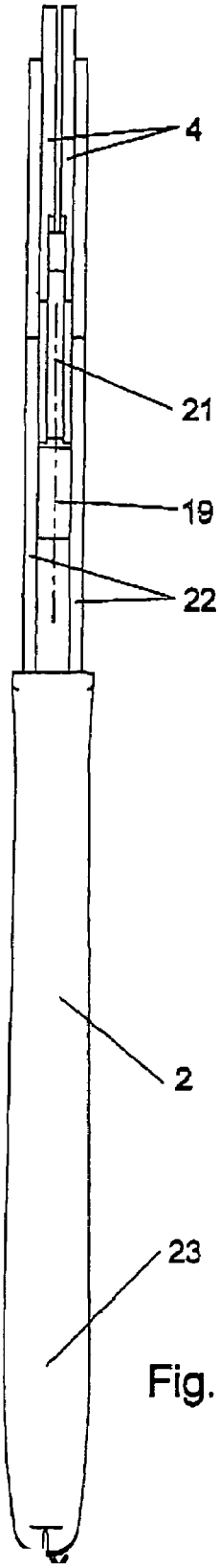
FIG. 2 is a side view of the pliers of FIG. 1.

It is to be seen from FIG. 2 that the first portion 21 is arranged as one piece in the center region, meaning in the plane of main extension 19 of the pliers. The moveable pivot jaw 4 is designed to include two portions. This means that it includes two plates which are milled out towards the first portion 21. The movable handle 2 also has such a plate design, the movable portion 22 being formed by two plates.

Figure 3:
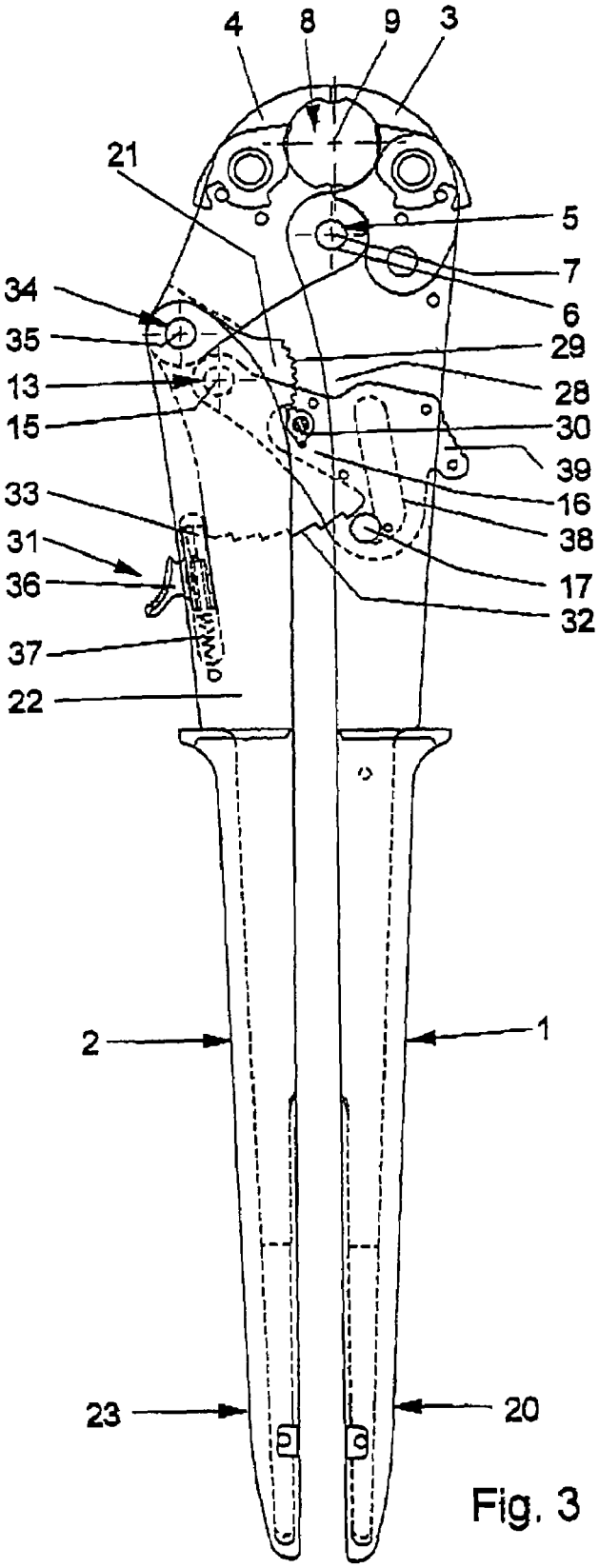
FIG. 3 is a top view of a second exemplary embodiment of the novel pliers.
Figure 4:
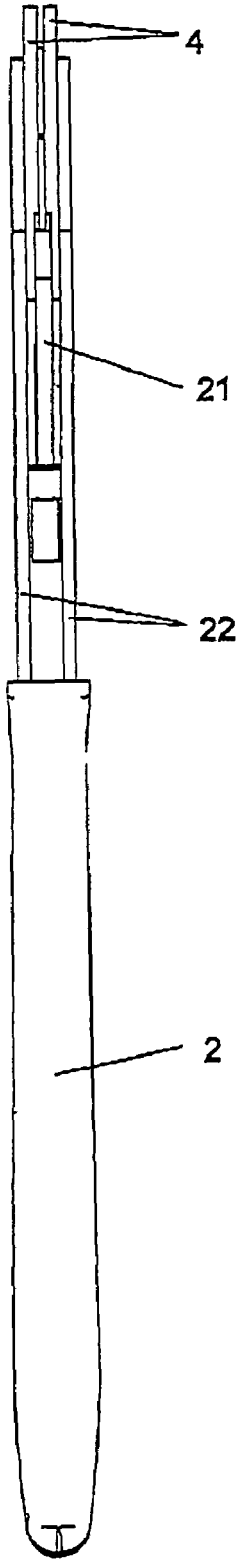
FIG. 4 is a side view of the pliers of FIG. 3.

The embodiment of the pliers according to FIGS. 3 and 4 has a lot in common with the embodiment of the pliers according to FIGS. 1 and 2. Consequently, it is referred to the above description with respect to FIGS. 1 and 2. In contrast, the pliers according to FIGS. 3 and 4 include a common joint 34 being arranged at the movable pivot jaw 4.

The common joint 4 fulfills the functions of the support joints 10 and 24. The second portion 22 in this case extends to the common joint 34. Both portions 21 and 22 are designed and arranged to be pivotable about the axis 35. They are also interconnected to realize a few crimping steps by means of the locking mechanism 31. The ratchet 33 includes a handle portion 36 to simplify its operation by hand. A spring 37 subjects the ratchet 33 towards the stops 32. The stops 32 are arranged at the first portion 21 in the shape of an arc.

To allow for a great opening width of the pliers, the pressure lever 16 includes an elongated hole 38 which is guided at the bolt of the third support joint 17. The pressure lever 16 may also include an actuation member 39.

Figure 5:
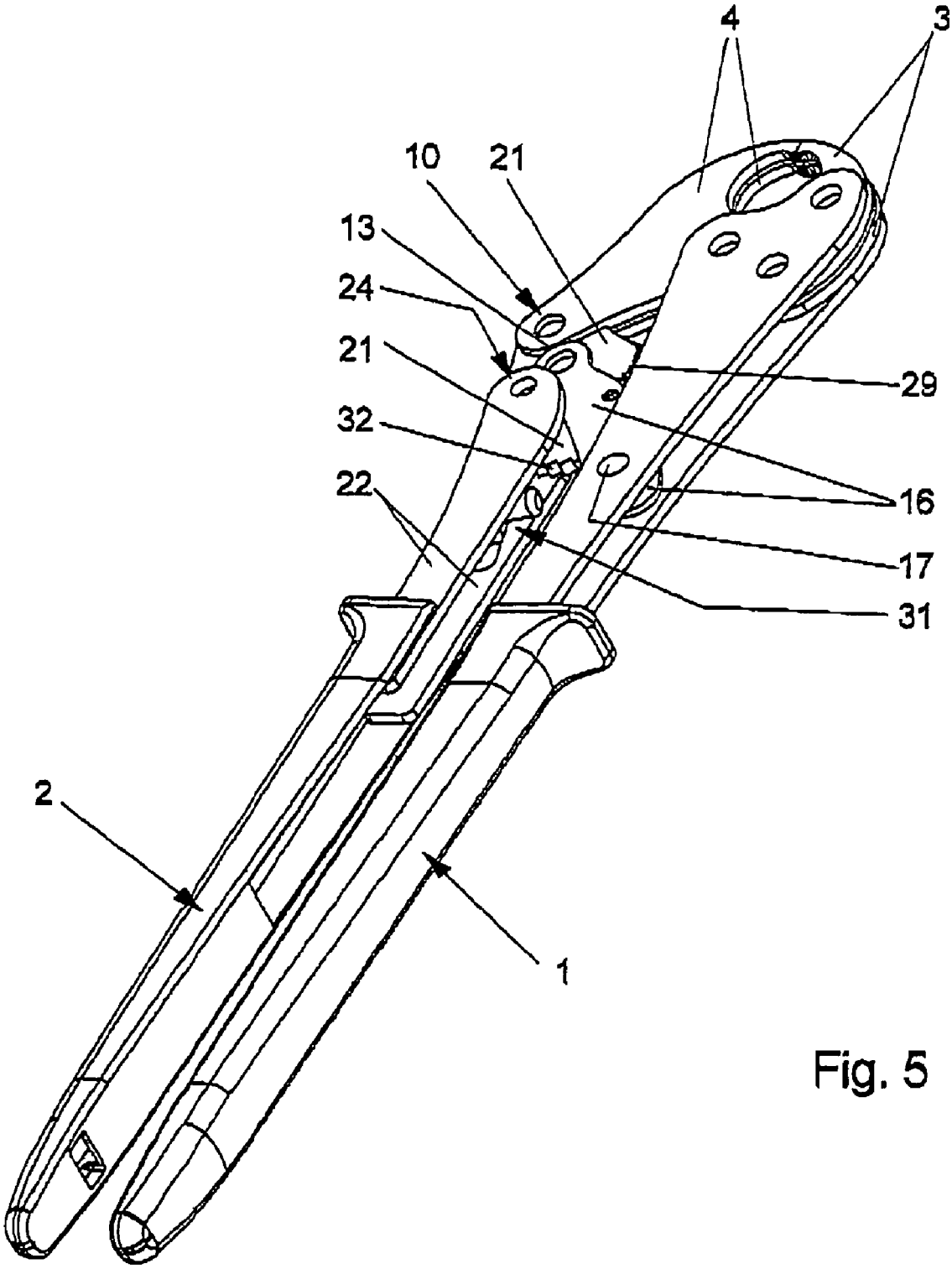
FIG. 5 is a perspective view of the pliers of FIGS. 1 and 2.

FIG. 5 is a perspective view of the pliers according to FIGS. 1 and 2. For reasons of clarity of the drawings, the bolts of the support joints 10, 13, 24, 17 as well as of the common pivot joint 5 and of the arrangement of the two plates of the stationary pivot jaw 3 at the stationary handle 1 are not illustrated. One may clearly see the position and the extension of the first portion 21. The second portion 22 includes two plates between which the components of the stop mechanism 31 are supported. The two plates of the stationary handle 1 and the two plates of the second portion 22 are located in the same plane. Two pressure levers 16 are arranged between the one-piece first portion 21 and the two plates of the second portion 22.

Figure 6:
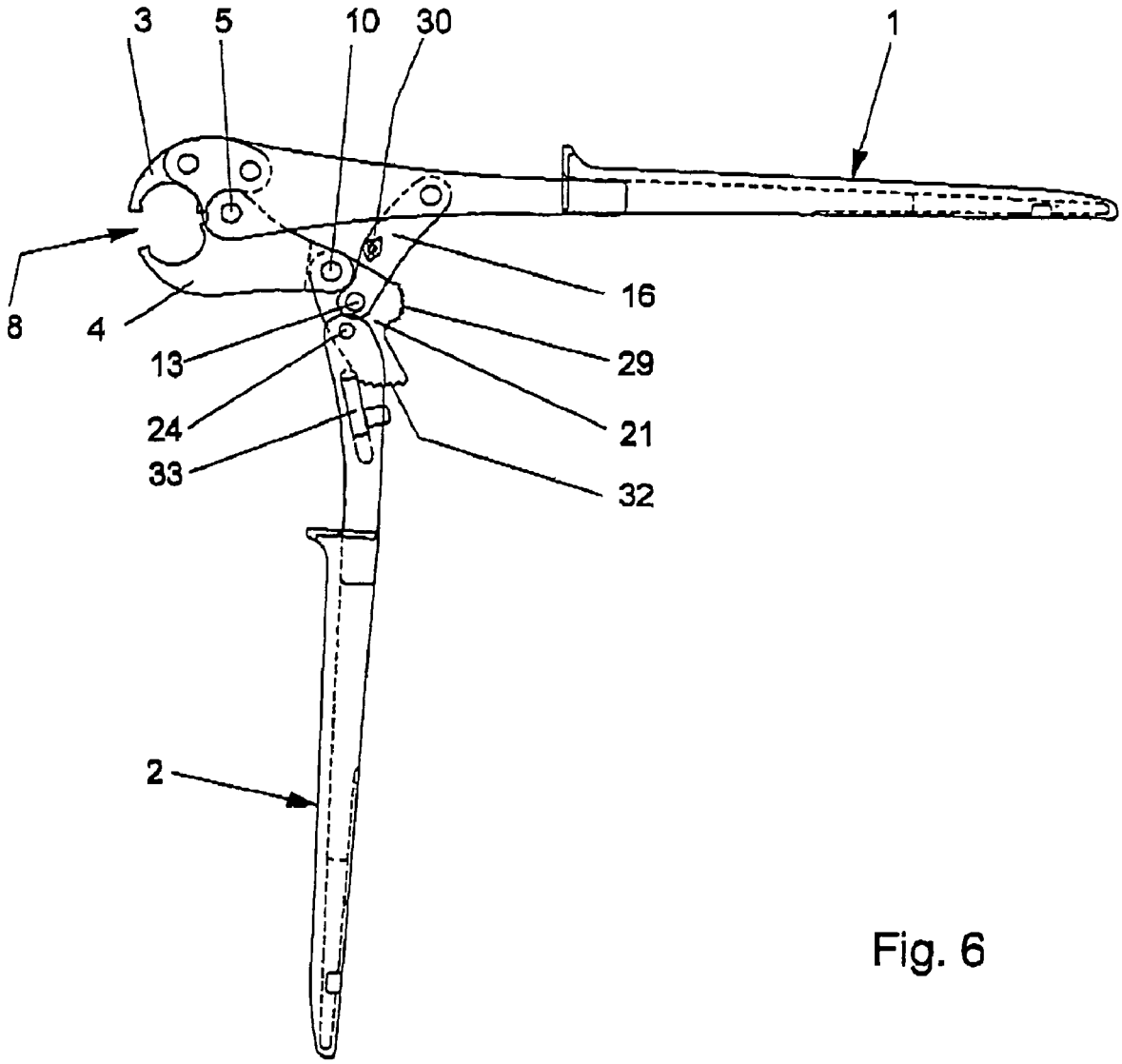
FIG. 6 is a view of the pliers of FIGS. 1, 2 and 5 in its maximally opened position.

FIG. 6 emphasizes the great opening width in the region of the crimping die 8 which allows for the pliers being used in a way that it covers conduits, ducts and the like, for example. It is to be understood that it not possible to operate the pliers with one hand in this condition. However, this is not necessary since the handles 1, 2 are only pivoted without crimping forces being applied.

Figure 7:
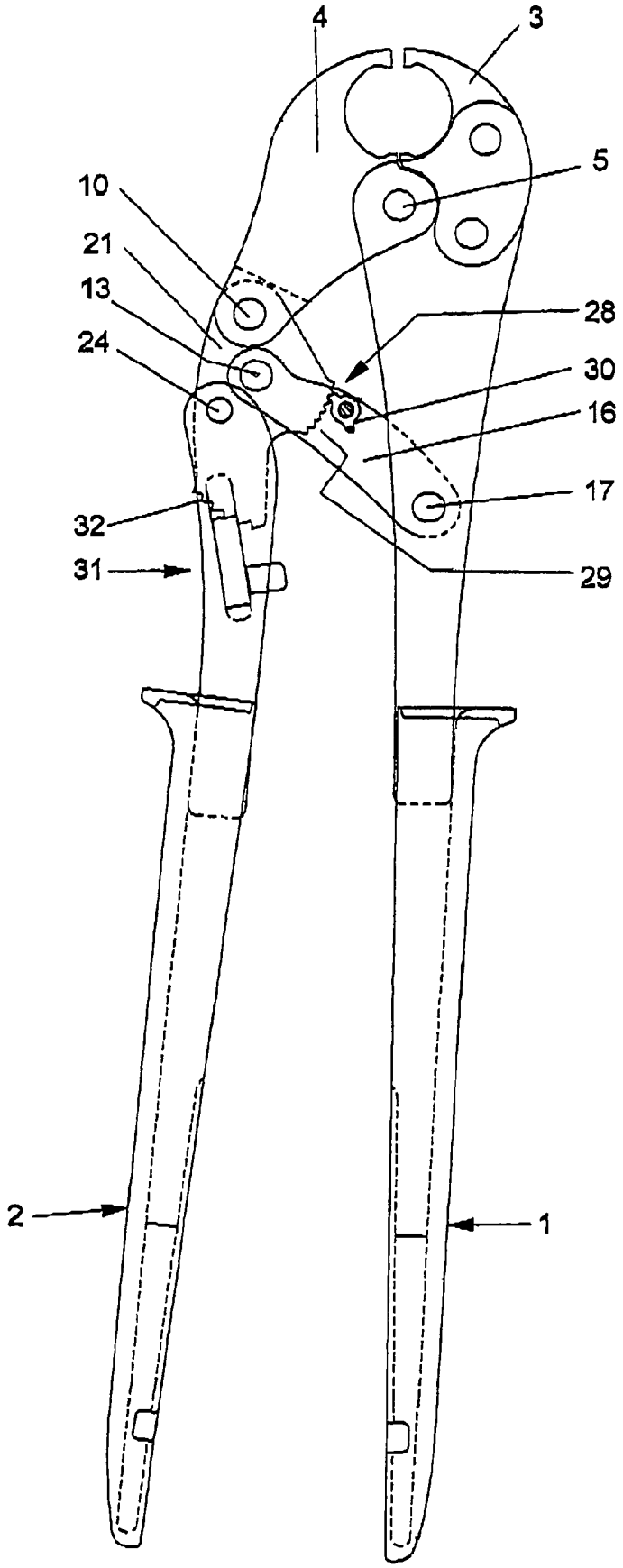
FIG. 7 is a view of the pliers according to FIGS. 1 and 2 in its mean position and crimping step.

FIG. 7 illustrates an intermediate position of the pliers during crimping of a work piece (not illustrated). It is to be seen from FIG. 7 that the locking mechanism 28 as well as the stop mechanism 31 are engaged. The relative position of the elements shown in FIG. 7 is attained at the beginning of a second crimping step in the crimping cycle.

Figure 8:
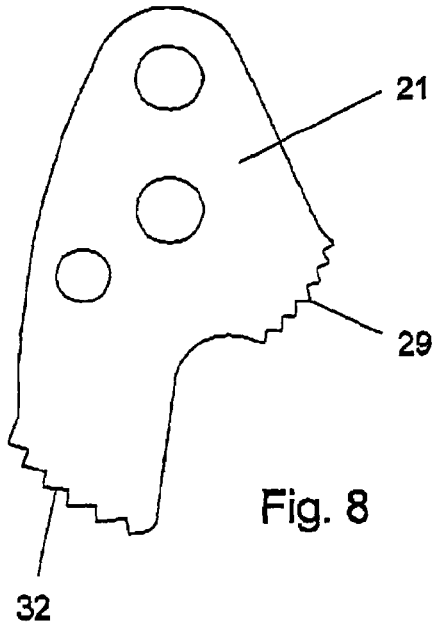
FIG. 8 is a top view of the portion of the movable handle.

FIG. 8 is a top view of the first portion 21 in greater detail. One may see the openings for arrangement of the support joints 10, 13 and 24 as well as the tooth segment 29 of the locking mechanism 28 and the stops 32 of the stop mechanism 31.

Figure 9:
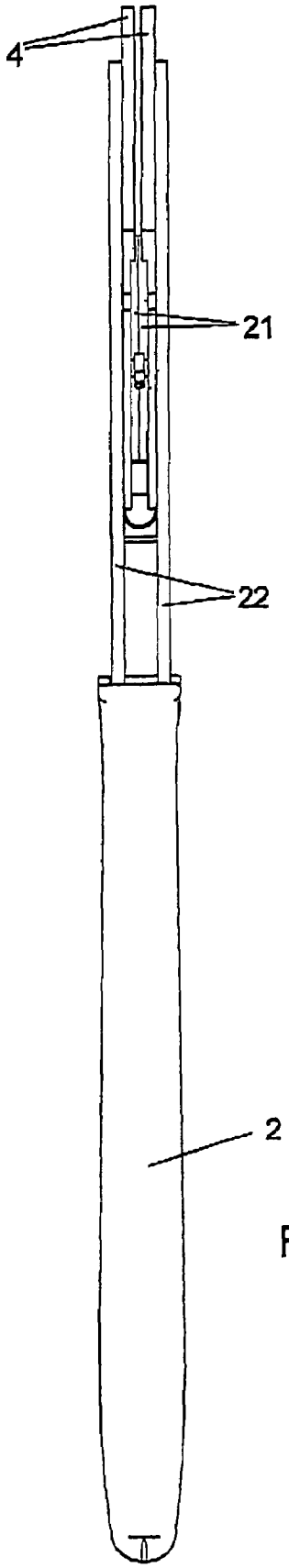
FIG. 9 is a side view of the novel pliers including a portion of the handle including two plates.

FIG. 9 is a similar view as FIG. 2. In the exemplary embodiment of the pliers according to FIG. 2, the first portion 21 is designed as one piece in the form of one single punched plate having the design as it is illustrated in FIG. 8. It is to be seen from FIG. 9 that the first portion 21 in this case is made of two punched plates having identical outlines.

Many variations and modifications may be made to the preferred embodiments of the invention without departing substantially from the spirit and principles of the invention. All such modifications and variations are intended to be included herein within the scope of the present invention, as defined by the following claims.

I claim:

1. Pliers for crimping work pieces, comprising:

a pliers head;

a first pivot jaw being arranged in the region of said pliers head;

a second pivot jaw being arranged in the region of said pliers head;

a common joint being designed and arranged to pivotally connect said first and second pivot jaw;

a first die being arranged at said first pivot jaw;

a second die being arranged at said second pivot jaw, said first and second die together forming a crimping die;

a first handle being operatively connected to said first pivot jaw and including an end portion facing away from said pliers head, said first handle being divided into at least a first portion and a second portion, said first portion being designed as a plate;

a second handle being operatively connected to said second pivot jaw and including an end portion facing away from said pliers head, said first handle and said second handle being designed and arranged to be movable with respect to one another and to be operable to crimp the work piece in a plurality of crimping steps;

a locking mechanism, said locking mechanism including a tooth segment and being designed and arranged to attain a defined closed position of said first die and said second die, said tooth segment being designed as one piece with said first portion of said first handle;

a stop mechanism, said stop mechanism including at least two stops and being designed and arranged to operatively connect said first portion and said second portion of said first handle in a plurality of different angle positions, a realized angle position of the plurality of different angle positions being different for each of the crimping steps, said at least two stops being designed as one piece with said first portion of said first handle; and a toggle lever drive, said toggle lever drive including a plurality of support joints and a pressure lever, said pressure lever operatively connecting said first portion of said first handle and said second handle, said pressure lever being supported by said plurality of support joints.

2. The pliers of claim 1, wherein said at least two stops are designed as a series of teeth.

3. The pliers of claim 1, wherein said first portion of said first handle being designed as a plate has a thickness, said tooth segment and said at least two stops being designed to extend along the entire thickness of said first portion of said first handle.

4. The pliers of claim 2, wherein said first portion of said first handle being designed as a plate has a thickness, said tooth segment and said at least two stops being designed to extend along the entire thickness of said first portion of said first handle.

5. The pliers of claim 1, wherein said pliers have a plane of main extension, said plate being designed as one piece, said pliers being arranged to be symmetric to the plane of main extension.

6. The pliers of claim 2, wherein said pliers have a plane of main extension, said plate being designed as one piece, said pliers being arranged to be symmetric to the plane of main extension.

7. The pliers of claim 3, wherein said pliers have a plane of main extension, said plate being designed as one piece, said pliers being arranged to be symmetric to the plane of main extension.

8. The pliers of claim 1, further comprising a common joint, said common joint being arranged at said first pivot jaw, said first and second portions of said first handle being supported in said common joint.

9. The pliers of claim 1, further comprising a support joint, said support joint being designed and arranged to interconnect said first and second portions of said first handle.

10. The pliers of claim 1, wherein said stop mechanism further includes a ratchet being biased by a spring, said ratchet being arranged at said second portion of said first handle, said ratchet being associated with said at least two stops of said stop mechanism.

11. The pliers of claim 1, wherein said stop mechanism further includes a ratchet, said ratchet being arranged at said second portion of said first handle, said ratchet being associated with said at least two stops of said stop mechanism.

12. The pliers of claim 1, wherein said pressure lever at an end facing away from said first portion of said first handle includes an elongated hole, said elongated hole being designed and arranged to allow for wide opening of said crimping die.

13. The pliers of claim 1, further comprising a second pressure lever, said pliers having a plane of main extension, said first and second pressure levers being arranged to be symmetric to the plane of main extension.

14. The pliers of claim 1, wherein said tooth segment and said stops are arranged the same sense of rotation.

15. The pliers of claim 1, wherein said first and second handle are designed and arranged to be operable with one hand.

* * * * *